US006095839A

United States Patent [19]

Kline

[11] Patent Number: 6,095,839

[45] Date of Patent: Aug. 1, 2000

[54] ELECTRICAL CONNECTOR

[75] Inventor: Richard Scott Kline, Harrisburg, Pa.

[73] Assignee: The Whitaker Corporation, Wilmington, Del.

[21] Appl. No.: 08/877,015

[22] Filed: Jun. 16, 1997

[51] Int. Cl.[7] ..... H01R 27/00

[52] U.S. Cl. ..... 439/224; 439/638; 439/660

[58] Field of Search ..... 439/224, 31, 638, 439/660

[56] References Cited

U.S. PATENT DOCUMENTS

| | | | |
|---|---|---|---|
| 4,457,570 | 7/1984 | Bogese, III | 439/59 |
| 4,632,475 | 12/1986 | Tomita | 439/1 |
| 4,715,819 | 12/1987 | Iwasa et al. | 439/31 |
| 4,865,553 | 9/1989 | Tanigawa et al. | 439/31 |
| 4,975,062 | 12/1990 | Evans et al. | 439/13 |
| 5,004,434 | 4/1991 | Aiello et al. | 439/636 |
| 5,176,526 | 1/1993 | Hillbish et al. | 439/108 |
| 5,551,883 | 9/1996 | Davis | 439/65 |
| 5,674,078 | 10/1997 | Davis et al. | 439/79 |

FOREIGN PATENT DOCUMENTS

| | | | |
|---|---|---|---|
| 0353421A2 | 8/1989 | European Pat. Off. | H01R 23/70 |
| 0 353 421 | 2/1990 | European Pat. Off. | H01R 23/70 |

OTHER PUBLICATIONS

International Search Report mailed Nov. 5, 1997, corresponding PCT application No. PCT/US97/10990 (three pages).

*Primary Examiner*—Neil Abrams
*Assistant Examiner*—T C Patel

[57] ABSTRACT

A multi-directional electrical connector (20) includes an insulated housing (22) having an electrical contact (60) disposed in a first cavity portion (38) of a contact receiving cavity (36). A contact portion (70) of the contact (60) extends into a second cavity portion (50) of the cavity to engage a mating contact received in the second cavity portion (50). The contact (60) includes a body (62) having a pair of contact portions (70) extending into two separate blade-receiving sections (52) of the second cavity portion (50). Each of the contact portions (70) may be mated with a mating contact inserted into the blade-receiving sections (52) from two adjacent faces of the housing (22).

5 Claims, 5 Drawing Sheets

ELECTRICAL CONNECTOR

FIELD OF THE INVENTION

The invention relates to an electrical connector for a package that is accessible alone at least two intersecting sides for receiving a mating electrical contact of a mating electrical connector.

BACKGROUND OF THE INVENTION

There is a need in today's electrical industry for connectors that are multi-directional connectors, that is, connectors that can be mated from more than one side of the housing. Examples include docking connectors, hinge connectors, battery connectors and the like. The ability to mate from more than one site of a connector gives greater flexibility to the equipment manufacture as well as the end user. For example, use of such a multi-directional connector in batteries reduces the amount of inventory needed with respect to specifically oriented battery connectors.

U.S. Pat. No. 5,551,883; filed Dec. 19, 1994, discloses a multi-directional connector that is accessible for mating from two adjacent sides. The connector includes a insulated housing having a contact receiving cavity with an electrical contact disposed in a first cavity portion at a contact portion of the contact extending into a second cavity portion to engage a mating contact received in one of two directions in the second cavity portion. The connector disclosed therein can mate with only one complementary connector. In some instances, however, it is desirable that the multi-directional connector be matable with two connectors simultaneously. In other applications, it is desirable that the connector be matable along three adjacent sides to give a mating capability of 180 degrees.

SUMMARY OF THE INVENTION

The electrical connector of the present invention includes an insulated housing having at least one contact receiving cavity therein and a contact having a body disposed in a first cavity portion and a pair of contact portions extending from the body into two separate portions of a second cavity portion. In accordance with the invention, the contact portions are at a 45 degree angle to the body and are at a 90 degree angle with respect to one another. Each of the contact portions maybe mated with a mating contact inserted into a second cavity portion from different sides of the housing. The electrical connector, furthermore, can be mated with two complimentary connectors thus commoning the two mating connectors.

It is an object of the present invention to provide a multi-directional connector that can be mated from three different directions.

It is a further object of the invention to provide a multi-directional connector that is also dual entry, that is, it can be mated with two connectors simultaneously.

Embodiments of the invention will now be disclosed with reference to the accompanying drawings.

DETAILED DESCRIPTION OF AN EMBODIMENT OF THE INVENTION

Figure 2:
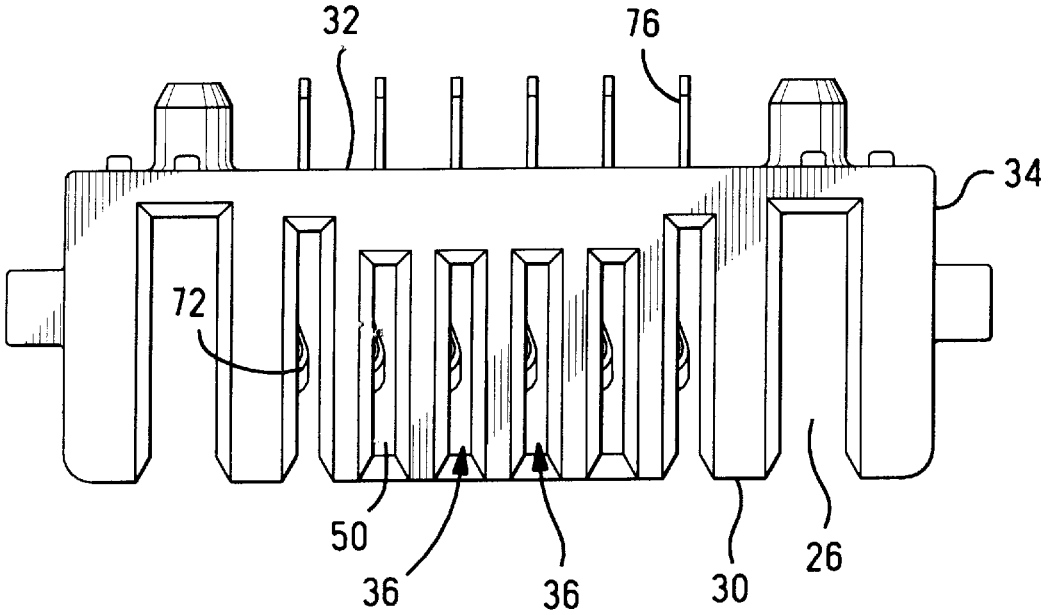
FIG. 2 is a side view of the connector of FIG. 1.

With reference to FIGS. 1 through 8, electrical connector 20 comprises in insulated housing 22 having at least one contact receiving cavity 36 and an electrical contact 60 in each cavity 36. Housing 22 includes a top face 24, opposed side walls or faces 28, 30, bottom wall or insertion face 32 and opposed end walls 34. Top face 24 is opposed to insertion face 32. Housing 22 further includes slots 26 extending into the housing proximate the end walls 34 and dimensioned to receive side walls of a mating connector (not shown). Each contact receiving cavity 36 includes a first cavity portion 38 for receiving the respective contact 60 and a second cavity portion 50 for receiving a mating contact 82 of a mating connector 80, as shown illustratively in FIGS. 7 and 8. The second cavity portion 50 communicates with the first cavity portion 36 and is open along the top or opposed face 24 and opposed side faces 28 and 30 thus comprising three blade-receiving faces of the housing 22 for receiving a mating blade contact. The second cavity portion 50 includes two blade-receiving sections 52, each section being in communication with two adjacent faces 24 and 28 or 24 and 30 of the housing 22. Housing 22 is adapted to be connected to a circuit board of an electrical device (not shown).

Figure 5:
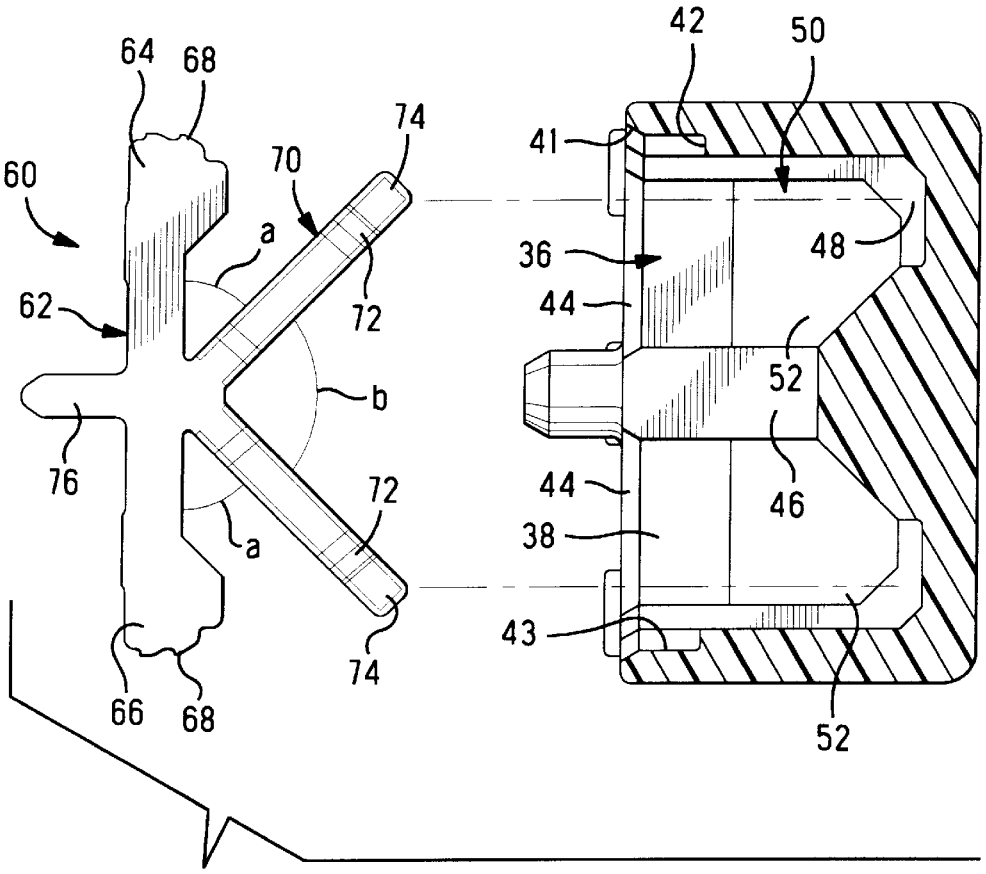
FIG. 5 is a cross-sectional view of the connector housing.
Figure 6:
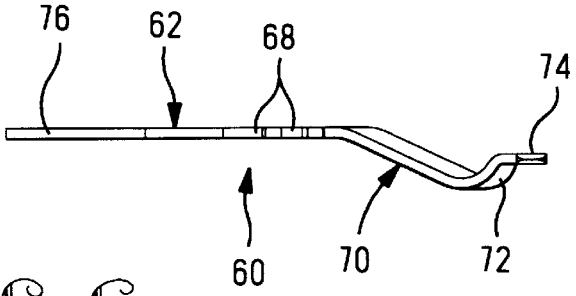
FIG. 6 is a side view of the stamped and formed contact.
Figure 7:
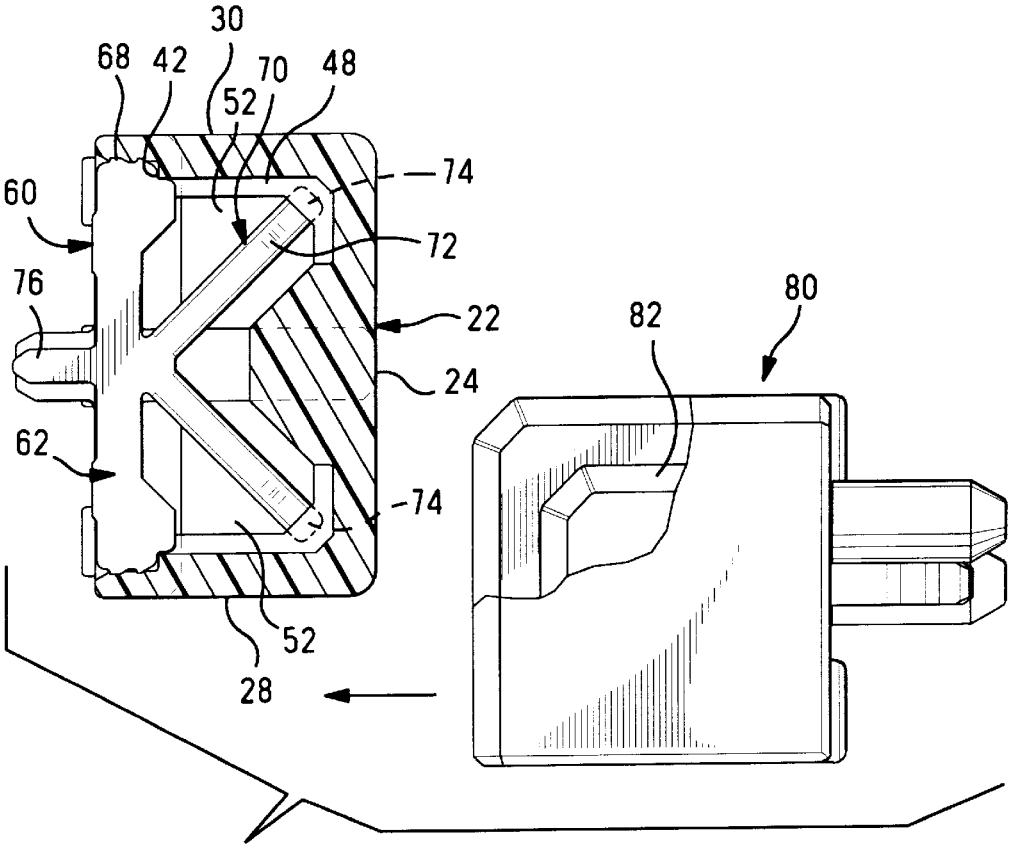
FIG. 7 is a view similar to FIG. 5 taken along line 7—7 of FIG. 1 with the contact disposed in the housing cavity and a mating connector exploded therefrom.

With reference to FIGS. 5, 6 and 7, contact 60 is of unitary construction, stamped and formed from a strip or blank of thin metal and has a thickness plane defined by the blank. Contact 60 comprises a body 62 having a pair of contact portions or arms 70 diverge and extend outwardly from an edge of the body 62 and forming a generally K-shaped contact. Each contact portion 70 extends substantially at a 45 degree angle, shown as angle "a", to body 62 and substantially at a 90 degree angle, shown as angle "b", with respect to the other contact portion 70. Body 62 extends to respective top and bottom ends 64, 66, each having barbs 68 thereon for retaining the contact 60 in a contact receiving cavity 36 as more fully discussed below. Contact arms 70 diverge and extend from a front edge of the body 62 and provide a pair of cantilevered resilient springs. The contact arms 70 have a curved contact surface 72 adjacent to the tips 74 thereof. Contact body 62 further has a terminal post 76 extending outwardly from the rear edge thereof and adapted to be mounted in a through hole of a circuit board or to a conductive pad on the surface of a board (not shown).

Referring now to FIGS. 3, 4, 6 and 7, the first cavity portion 38 of each contact receiving cavity 36 projects forwardly from the contact insertion face or bottom wall 30 toward the top or opposed face 24 of the housing 22. First cavity portion 38 includes an elongate channel portion 40 extending to ends 41, 43 proximate side faces 28, 30 and two second channel sections 44 that are in communication with the elongate channel 40 and have a wall 46 extending partially therebetween. Channels 40 and 44 are slightly wider than the thickness plane of the contact 60 to receive the contact body portion 62 with the top and bottom 64, 66 thereof received in the elongate channel 40 and the diverging contact arms 70 extending Forwardly into the two blade-receiving sections 52, as best seen in FIG. 7. The ends 64, 66 of the contact body 62 extend into recesses 42 at the ends of the elongate channel 40 with the barbs 68 engaging the surfaces thereof to retain the contact 60 in the housing cavity 36. As can be seen from these Figures, the contact arms 70 extend forwardly of the body 62 to occupy a forward portion of the contact receiving cavity 36 that is unoccupied by the contact body 62. The contact surfaces 72 of contact arms 70 extend forwardly into the second cavity portion 50 and into respective blade-receiving sections 52. First cavity portion 38 further includes a wall portion 48 that retains the tips 74 of the contact arms 70 in first cavity portion 38 and provides overstress protection.

Figure 1:
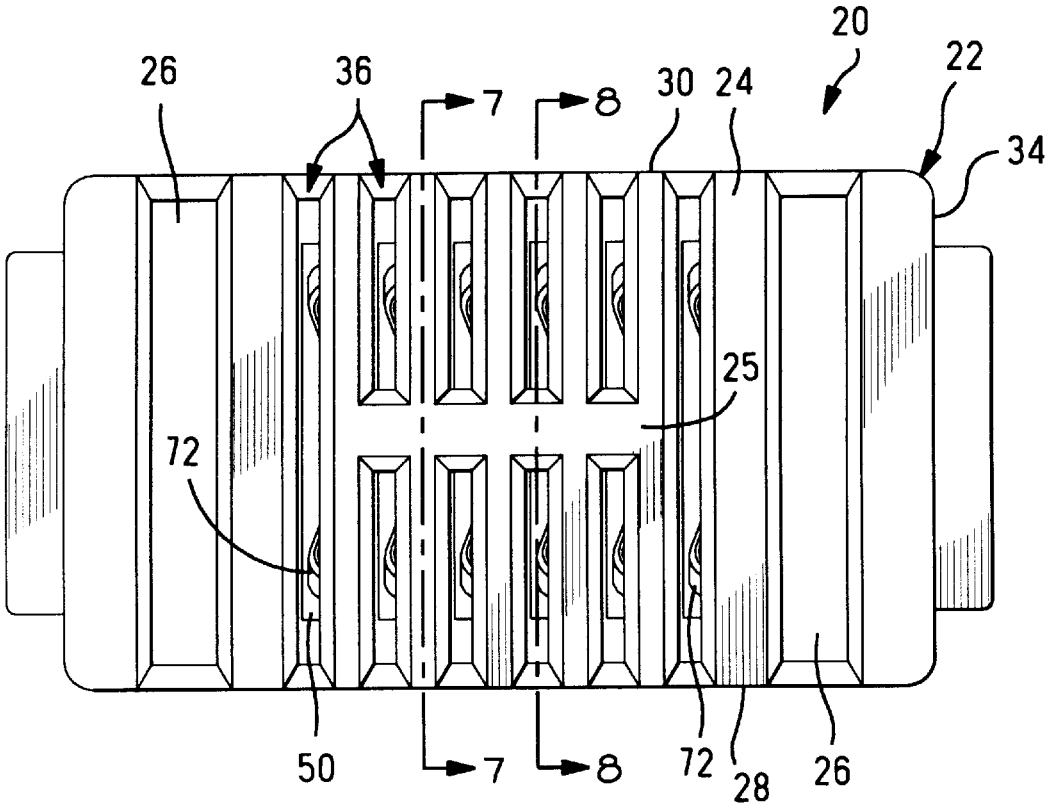
FIG. 1 is top view of a connector made in accordance with the present invention.
Figure 3:
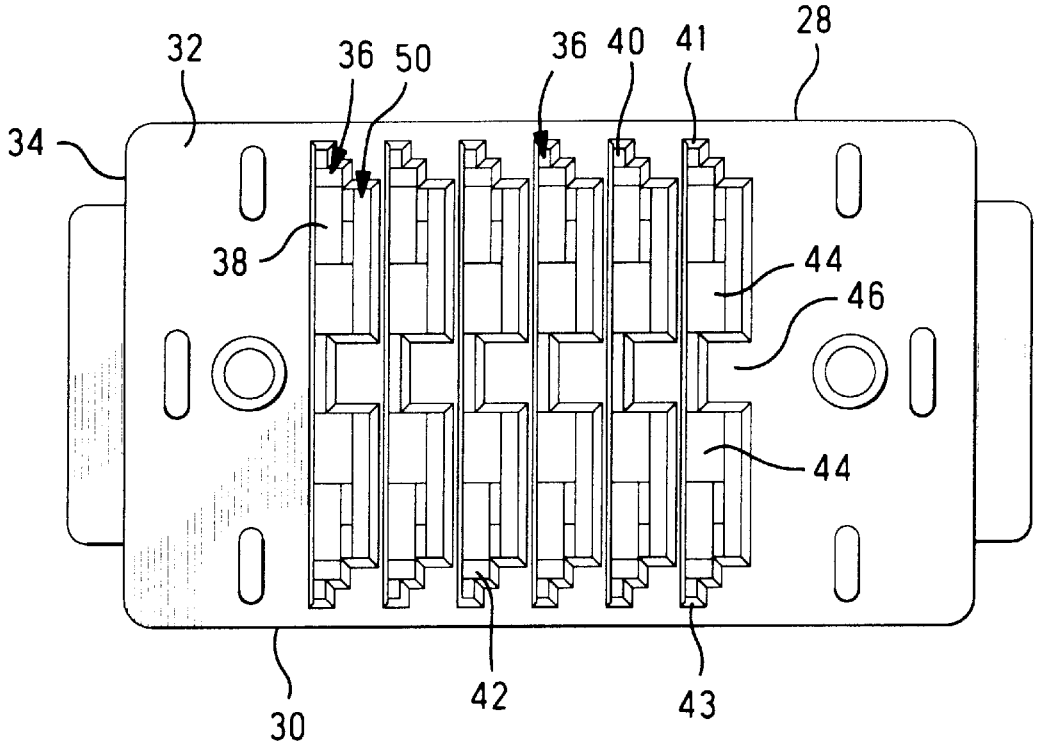
FIG. 3 is bottom plan view of the connector of FIG. 1 with the contacts removed.
Figure 4:
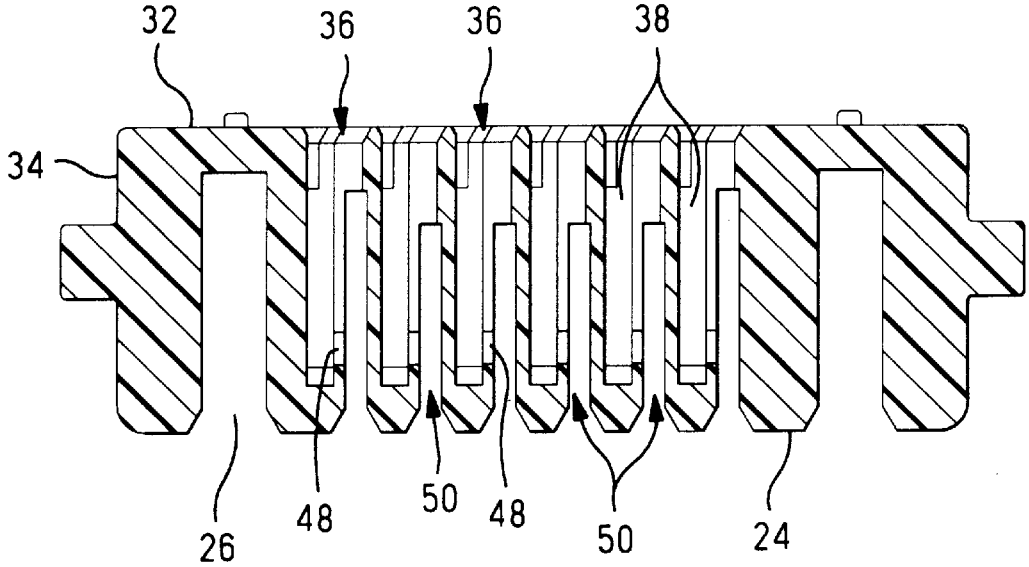
FIG. 4 is a longitudinal sectional view of the connector of FIG. 1 with the contacts removed.

In one representative embodiment as shown in FIG. 1, the two contact receiving cavities 26 proximate the end walls 34 are continuously open between the respective side walls or faces 28, 30 while the remaining contact receiving cavities 36 are divided by center wall portion 25. The longer cavities are provided to allow for a longer contact length for the mating connector to provide a make-first, break-last interconnection, as known in the art.

Figure 8:
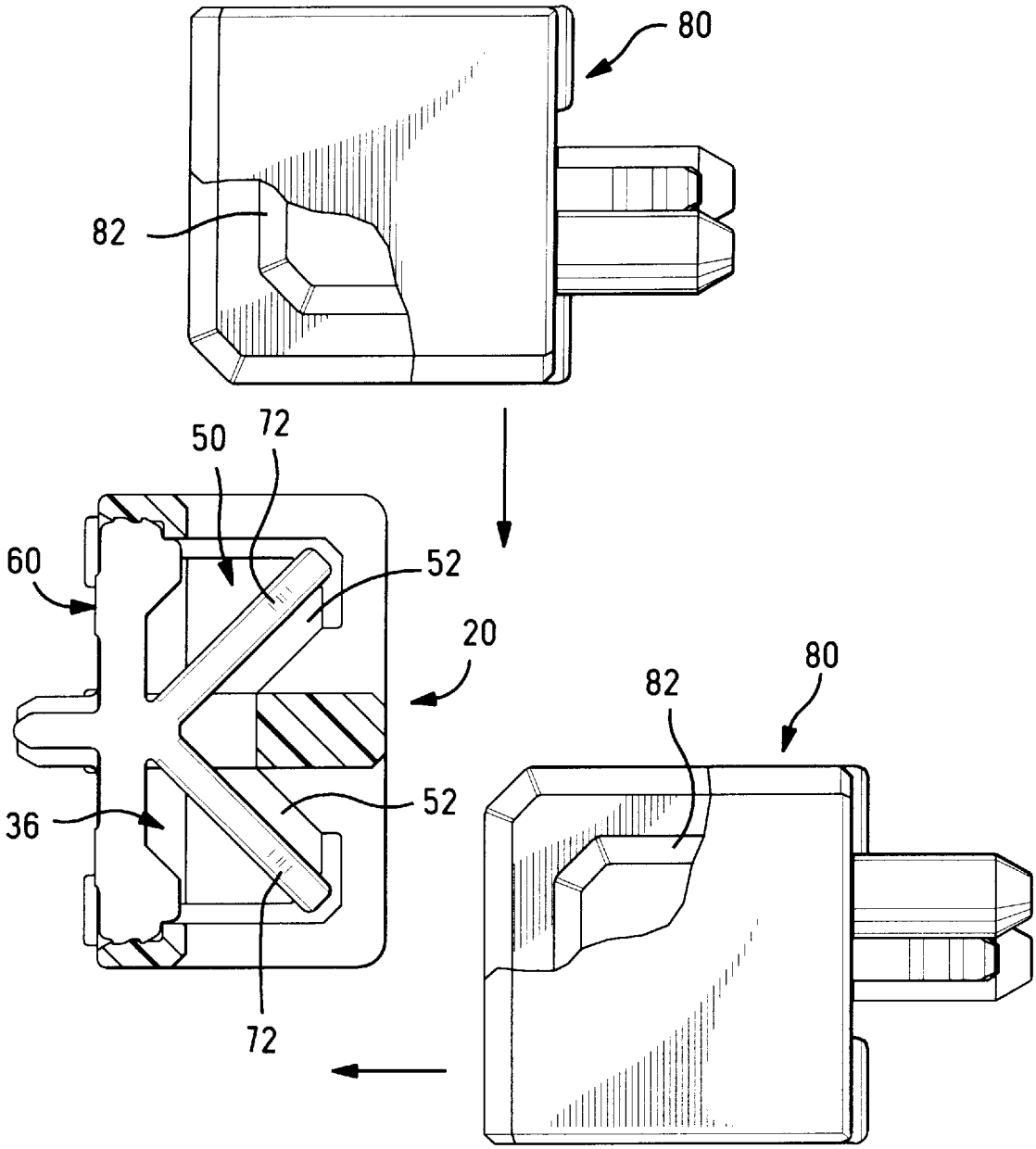
FIG. 8 is a side view of a connector of the resent invention taken along line 8—8 of FIG. 1 with two mating connectors exploded therefrom.

As can be seen from FIGS. 1, 2, and 8 the connector 20 of the present invention is multi-directional in that it can mate with contact inserted into the blade-receiving sections 52 from side faces 28, 30 and opposed or top face 24 and, in addition, as shown in FIG. 8, can also mate with two connectors 80 simultaneously. Connectors 80 are, for example, of the type disclosed in U.S. Pat. 5,551,883.

Figure 9:
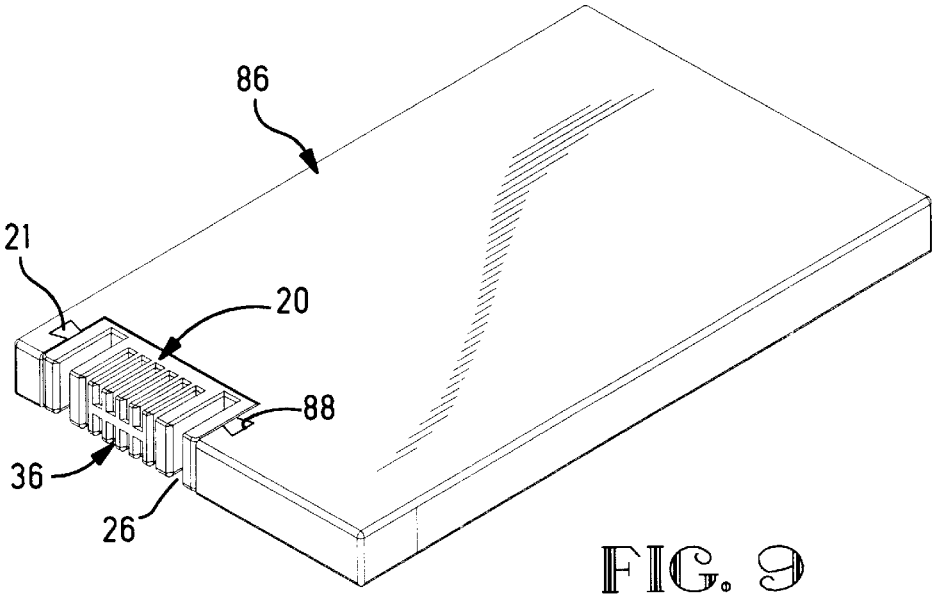
FIG. 9 is an isometric view of a battery incorporating the connector of FIG. 1.

FIG. 9 illustrates a package 86 for a rechargeable battery that includes battery cells connected to a circuit board all inside the package (not shown). The terminal posts 76 of the of contact 60 are connected to the same circuit board as are the battery cells such that the connector 20 of FIGS. 1 through 8 becomes incorporated with the battery and the package 86. The connector 20 is provided with unitary interlocks 21 in the shape of dovetail tongues that fit into mating interlocks 88 in the form of dovetail grooves in the package 86.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector including an insulated housing having at least one contact receiving cavity therein, an electrical contact disposed in a first cavity portion of said cavity, a contact portion extending into a second cavity portion of the cavity to engage a mating contact received in the second cavity portion, the connector being characterized in that:

said contact includes a body, having a pair of diverging contact portions extending into two separate blade-receiving sections of said second cavity portion, each said blade-receiving section being in communication with two adjacent faces of said housing;

whereby each of said contact portions can be mated with a respective mating contact inserted into a respective said second cavity portion from one of two adjacent faces of said housing for receipt of a blade thereinto.

2. The electrical connector of claim 1 wherein each said contact portion extends at a substantially 45 degree angle to said body and at a substantially 90 degree angle to each other.

3. The electrical connector of claim 1 wherein said housing includes a contact insertion face and an opposed face and opposed side faces, each adjacent to said opposed face, with each blade-receiving section being in communication with said opposed face and one of said opposed side faces.

4. The electrical connector of claim 3 wherein said connector is matable with two complementary connectors simultaneously, each of said complementary connectors having a like plurality of contacts, whereby said connector electrically connects the corresponding contacts of the respective mating complementary connectors.

5. The electrical connector of claim 1 wherein said first cavity portion includes an internal wall portion dimensioned to receive tips of said pair of contact portions thereby providing overstress protection for said contacts.

* * * * *